United States Patent [19]

Del Bon

[11] 4,333,585

[45] Jun. 8, 1982

[54] DEEP-DRAWN PREFORMED CLOSURE FOR THE HERMETIC SEALING OF A CAN OR SIMILAR CONTAINER

[76] Inventor: Luigi Del Bon, 141 Feldstrasse, 4663 Aarburg, Switzerland

[21] Appl. No.: 56,404

[22] Filed: Jul. 10, 1979

[30] Foreign Application Priority Data

Jul. 10, 1978 [CH] Switzerland ..... 7454/78
Feb. 17, 1979 [CH] Switzerland ..... 1539/79

[51] Int. Cl.[3] ..... B65D 3/12; B65D 3/22; B65D 41/50

[52] U.S. Cl. ..... 220/359; 220/258; 220/270; 220/276; 220/458; 229/5.5

[58] Field of Search ..... 215/256; 220/258, 270, 220/276, 359, 454, 457, 458; 229/5.5

[56] References Cited

U.S. PATENT DOCUMENTS 3,397,809 8/1968 Ellerbrock ..... 220/277
3,465,907 9/1969 Dorn et al. ..... 215/256
4,003,496 1/1977 Ostrem ..... 220/270

FOREIGN PATENT DOCUMENTS 277860 1/1970 Austria ..... 220/258
2061497 6/1972 Fed. Rep. of Germany .
2256661 7/1975 France ..... 220/258
567977 10/1975 Switzerland .
1124636 8/1968 United Kingdom .

*Primary Examiner*—Allan N. Shoap
*Attorney, Agent, or Firm*—Heinrich W. Herzfeld

[57] ABSTRACT

A sealed can or similar container having a can body the wall of which is internally lined with a coating is sealed with a deep-drawn membrane in a manner which leaves on the inside of the can wall surrounding a can top opening an annular zone uncovered by said membrane, but with the coating of the can wall intact, which annular zone extends between a lower internal edge of a rim-covering part of the membrane and the upper edge of a collar part of the membrane, which collar part is integral with, and extends upwardly from and surrounds a flat part of the membrane which covers the said can opening, and which collar part is glued or welded to the inside of the can wall beneath said uncovered zone. A preformed closure element destined for sealing fastening in a can opening, a process and apparatus for producing a rupturing zone in which preformed closure element, and a process and apparatus for manufacturing a sealed can with the aid of the preformed closure element are also described.

3 Claims, 17 Drawing Figures

FIG. 3
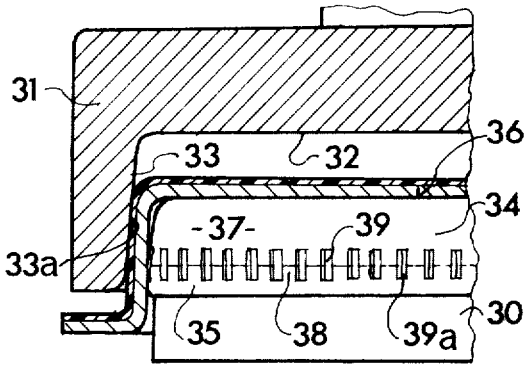
FIG. 4
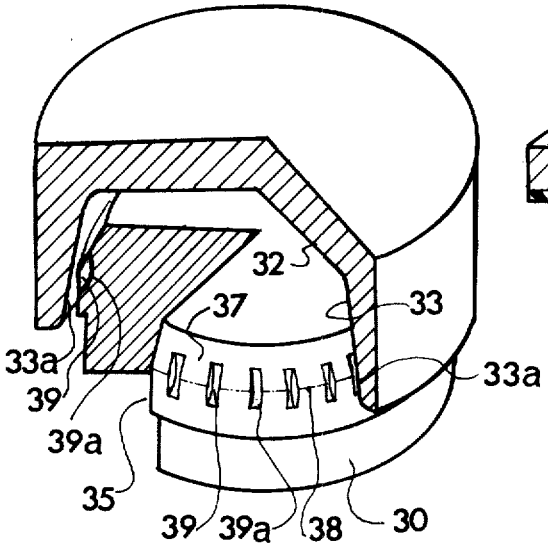
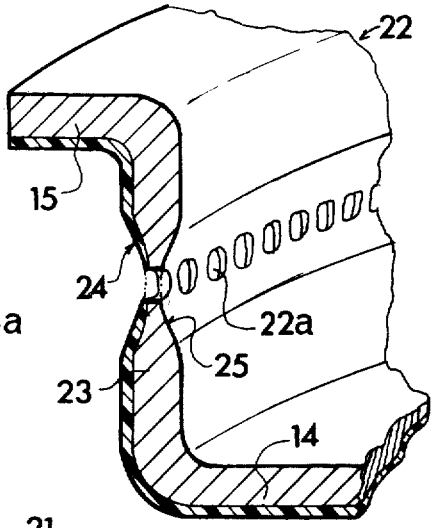
FIG. 6
FIG. 12
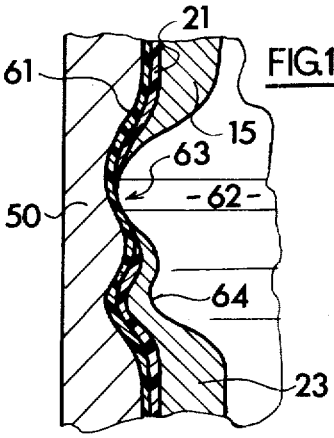
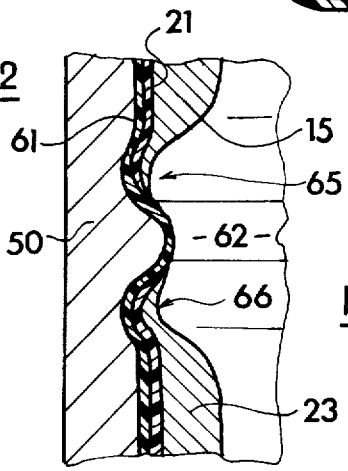
FIG. 13

FIG. 3
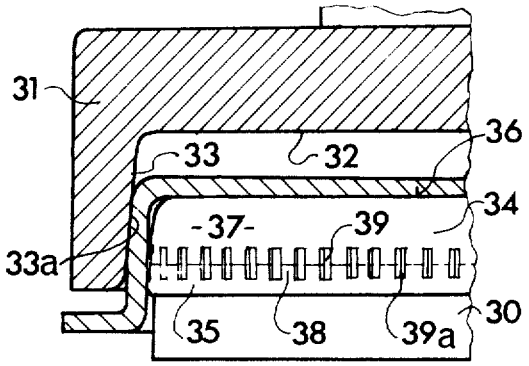
FIG. 4
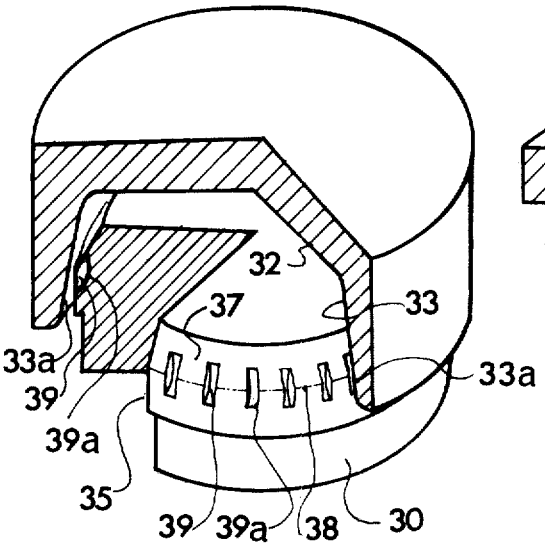
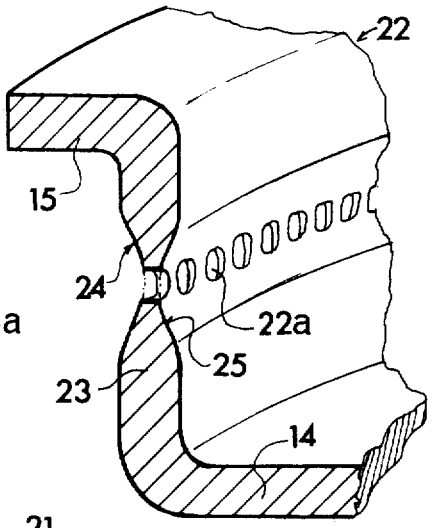
FIG. 6
FIG. 12
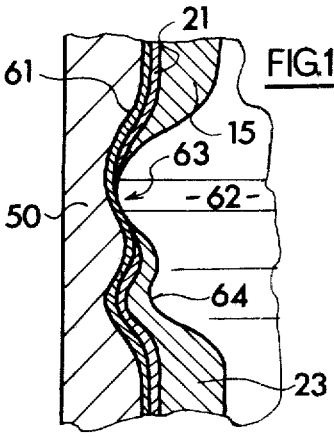
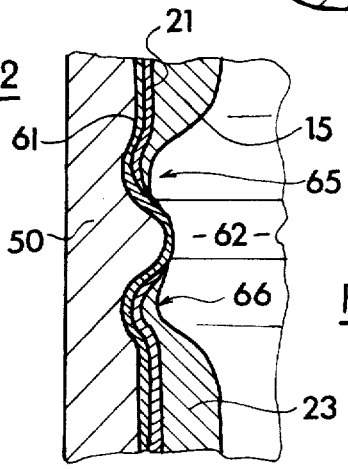
FIG. 13

DEEP-DRAWN PREFORMED CLOSURE FOR THE HERMETIC SEALING OF A CAN OR SIMILAR CONTAINER

BACKGROUND OF THE INVENTION

This invention relates, in a first aspect, to a can or similar container having a can body the wall of which is internally lined with a protective coating, and a top opening therein, a membrane deep drawn from an aluminum foil or similar sheet material, serving as a warranty seal, which membrane comprises a flat part across the top opening and a collar part welded or glued sealingly to the coating on the inside wall of the can body, surrounding the top opening, which collar part extends from the plane of the flat part toward the rim of the top opening, with the upper edge of the flat part terminating on the inside of the can rim about the top opening, while a rim-covering part of the same foil or similar sheet material is crimped about the said can rim and extends on the inside wall, about the top opening of the can body, and terminates with its lowermost inner edge above the upper ede of the collar part of the membrane.

The invention also relates, to a process for sealing an opening of a can having a can body the wall of which is internally lined with a protective coating, which process comprises.

(a) introducing into the can opening a deep-drawn closure membrane having a flat part destined for covering the can opening, a collar part destined to be sealingly affixed on the inside of the wall of the can body near the can opening, and a peripheral part surrounding the collar part and destined for covering the rim of the can wall surrounding the can opening, (b) crimping the peripheral part of the membrane about the rim of the can wall about the can opening thereby bringing the collar part and the adjacent circumferential zone of the peripheral part of the membrane to lie against the inside of the can wall adjacent and about the can opening in a contact zone of the membrane. In another aspect, the invention also relates to apparatus for carrying out the above-described process in practice.

Furthermore, the invention relates to a pre-formed closure element adapted for producing therefrom a can as described hereinbefore, which element comprises a membrane deep-drawn from an aluminum foil or a similar sheet material, which membrane consists essentially of a flat part, adapted for covering a top opening in the can body, and of a collar part destined to be glued or welded to the inside wall surrounding the top opening of the can body, which collar part has, in at least one annular membrance zone, parallel to the junction of the flat part and the collar part, a reduced thickness or a series of perforations, constituting a desired rupturing line; and the invention also relates to a process and apparatus for manufacturing a rupturing zone in a closure membrane destined for sealingly closing the opening of a can, and, in particular, the type of sealing closure to be found in the sealed can of the first described aspect of the invention.

It is conventional, especially in the case of cans containing foodstuffs, to not merely close the can with a lid, but also to provide, under the lid, a closure element consisting of a membrane of aluminum or aluminum laminate which can be pulled out of the can opening by tearing along a rupturing line or zone, after the lid has been lifted off the can.

Such aluminum membranes or foils are usually attached a few millimeters below the uppermost can rim and are provided by deep drawing with a marginal or collar part which extends in contact with the can wall upward to the said can rim. A tab is usually provided on the membrane, in particular on the flat part thereof which covers the can opening, and when pulling at the tab the flat part of the membrane will be torn out with a more or less clean tear which forms along a rupturing line or zone provided in the membrane.

This rupturing line or zone can be provided in the flat part of the membrane, or in the angle zone in which the flat part and the collar part join one another, or it can be provided in the peripheral marginal or collar part of the membrane.

In the case of round cans having a cylinrical body, the rupturing line or zone is usually a circular groove in which the thickness of the membrane is reduced.

It is known to produce this circular groove mechanically by scoring, which, however, has the drawback of reducing the thickness of the respective zone of membrane in a very irregular manner.

The wedge-shaped cross-section of the groove which occurs when the latter is produced by scoring with a conventional scoring tool produces centers of high tensile stress in the material which can lead to undesired rupture of the membrane due to jolting of the cans during transport.

According to another known method, a groove, to serve as rupturing zone, is crimped or impressed in the collar part of the membrane, which extends upward on the inside can wall toward the rim about the can opening. However, the reduction in the thickness of the membrane in this case is so small that, when the flat part of the membrane is to be severed and pulled out of the collar part, the membrane usually tears irregularly adjacent, but not along the desired rupturing line.

In a known device, which is inserted in a can, a membrane is permanently deformed between two pressure faces which are harder than the membrane, but only in a rupturing zone and, in particular, with a deformation which leads to a complete separation of the membrane into two parts.

A deformation of the membrane only in the rupturing zone between two hard pressure faces occurs, for instance, in the can closing method described in German Pat. No. 2,061,497 to Zeiler AG. In this can closing method the collar part of a deep-drawn membrane is glued onto the body of the can and is then cut through, whereby two separate membrane parts are formed which have along the incision line blunt edges abutting with one another.

This method has the drawback that it is practically impossible to make the incision with such precise depth that only the membrane and not the inside coating of the can, which is present in most modern cans, is cut; in practice, the incision will always penetrate through the coating into the material of the wall body itself. Regardless of whether this material is tin plate or cardboard, the destructin of the coating in the rupturing zone is highly undesirable for hygienic reasons, since, in particular if the can wall is made of cardboard, residues of a liquid content of the can will penetrate into the cardboard and will form crusts upon drying and become decomposed. In the case of metal cans, cutting of the coating, especially when the latter is of another metal, may cause electrochemical processes which may change the taste of the can contents. Moreover, cutting through the coating and into the material of the can wall may sever small particles thereof which may drop into the contents of the can.

The known methods have the common drawback that application of the desired rupturing line is time-consuming and demands a high accuracy of work. A further drawback consists in that, in the case of membranes of rectangular cans, it is difficult to produce a groove in the vicinity of the four corners of the can.

OBJECTS AND SUMMARY OF THE INVENTION

Therefore a first object of the invention is to provide a sealed can of the initially described type in which the above-mentioned drawbacks are avoided and the internally lined body of the can remains inviolate even after the membrane has been removed therefrom.

Furthermore, it is an object of the invention to provide methods and apparatus which will simplify, and reduce the cost of, producing such sealed cans having an intact internal coating.

It is already known to provide the membranes which seal the can opening with a tab or tongue which facilitates pulling out the flat part together with the collar part of the can. It is also known how to affix such pull-tabs. However, the invention sets out to solve other problems which occur when glueing or welding together certain portions of the sealing or closure membrane to the wall of the can.

In order to give shape to the membranes, apparatus are used which comprise an anvil member or piston member and a mortar member or die member which cover the former.

The above-explained problems are solved and aforesaid objects are attained in a sealed can of the initially described type which, in accordance with the invention, is provided on the inside of the wall surrounding the can opening with an uncovered and intact annular zone of the coating located between the lowermost inner edge of the membrane rim-covering part and the upper edge of the collar part, whereby removal of the flat part of the membrane by pulling the latter out of the can top opening also removes the entire collar part of the membrane while leaving the internal lining on the wall of the can body intact.

At least one continuous circumferential groove can be impressed in the inside of the wall of the can body and in the coating covering the same, in the uncovered annular zone. In this case, at least one of the two longitudinal sidewalls of the circumferential groove is preferably constituted by the bent-in lowermost inside edge portion of the rim-covering part or by the bent-in upper edge portion of the collar part of the membrane.

In particular, the upper one of the two longitudinal sidewalls of the circumferential groove is constituted by the inwardly bent lowermost inside edge portion of the rim-covering part and the lower one of these sidewalls is constituted by the inwardly bent upper edge portion of the collar part of the membrane.

Furthermore, in another embodiment of the sealed can according to the invention an upper and a lower continuous circumferential groove can be impressed in the inside wall of the can body in the uncovered annular zone, the upper longitudinal sidewall of the upper circumferential groove being constituted by the bent-in lowermost inside edge portion of the rim-covering part, and the lower longitudinal sidewall of the lower groove is constituted by the bent-in upper edge portion of the collar part of the membrane, while the lower longitudinal sidewall of the upper groove and the upper longitudinal sidewall of the lower groove are constituted by bent-in circumferential portions in the annular zone between the two grooves, which is uncovered by the collar part of the inside wall of the can body in which annular zone the coating is intact.

Frequently, the foil or sheet, from which the above-mentioned preshaped sealing element is produced by deep drawing, may be lined on its underside, which faces toward the interior of the can, with one or several layers of varying thickness which consist of self-adhesive material which will act as an adhesive when heated, but will not do so at room temperature. A thermo-lacquer is preferred for this purpose.

If this layer is relatively thick, it will render severance of the rim-covering part of the membrane from the collar part and of the latter from the flat part of the membrane difficult because of its elasticity. In this case, the formation of grooves or bighted portions at the desired line of rupturing will not be sufficient to provide a clean severance, and an unobjectional formation of the uncovered annular zone between the two severed membrane parts. Rather, this is achieved with particular ease when using a preformed closure element of the initially described type which is characterized in accordance with the invention in that the collar part has, in at least one annular membrane zone, parallel to the junction of the flat part and the collar part, a reduced thickness or a series of perforations, constituting a desired rupturing line. In this case, as in preceding ones, the membrane can further comprise a peripheral rim-covering part destined for covering the rim of the can surrounding the can top opening.

A preformed closure membrane is manufactured according to the process mentioned hereinbefore, which comprises the steps of:

(a) deep drawing from an aluminum foil or similar sheet material the closure membrane with a flat part destined for sealingly covering the can opening, and with a collar part destined for being welded or glued to the inside of the wall of the can surrounding the can opening, and (b) placing a circumferential zone of the collar part or of the flat part, which zone in the flat part is in the vicinity of the junction of the flat part and the collar part, between two pressure faces having a hardness greater than the membrane, and moving the two pressure faces toward or past one another in the general direction of an axis central and perpendicular to the flat part of the membrane, the two pressure faces approaching each other to leave a gap therebetween of a diameter smaller than the thickness of the deep-drawn membrane, thereby reducing the thickness of the membrane along a circumferential line destined to be ruptured; whereupon (c) the closure membrane is used for covering the can opening to sealingly close the same.

Step (a) can also be carried out to produce a deep-drawn membrane which further comprises a peripheral part destined to cover the rim of the can about the can opening.

In a preferred mode of carrying out this process, contact of the membrane during step (b) is in a continuous contact zone with one of the two pressure faces, but is in discontinuous contact with the other pressure face, which has interruptions spaced from one another, thereby producing a series of perforations in the zone of reduced diameter of the membrane along the line thereof destined to be ruptured when at least the flat part of the membrane is to be removed from the can opening. The perforation of the preformed closure membrane can also be produced in a simple manner by applying to the outside of the membrane, which is still on the anvil member of the apparatus for producing a rupturing line or zone, a pressure roll which generates the rupturing line or zone during rotation of the anvil member, and which also produces the perforations concurrently therewith, when using a pressure roll provided with projections or teeth.

An apparatus according to the invention for producing a zone destined to be ruptured in a deep-drawn membrane which has a flat part destined to cover an opening of a can, a collar part destined to be glued or welded to the inside of a can wall surrounding the can opening and optionally a peripheral part destined to cover the rim of the can wall which surrounds the can opening, comprises an anvil member and a mortar member each of which members has a pressure face, and drive means adapted for moving the anvil member and the mortar member toward one another with their pressure faces approaching or passing one another, but leaving a gap therebetween of a diameter smaller than the thickness of the deep-drawn membrane, whereby when the membrane is placed between the anvil member and the mortar member, the zone of the membrane, located in the gap during movement of the anvil member and the mortar member toward each other, is reduced in thickness to be the zone destined to be ruptured.

Preferably, the anvil member comprises a head-part of cylindrical or prism-shaped configuration, and wherein the pressure face of the anvil member is located at a circumferential region of the head-part, while the mortar member has a surface part thereof, facing toward the anvil member, and a cavity in the surface part, the cavity having a sidewall tapering with decreased cavity diameter inwardly toward the bottom of the cavity, the pressure face of the mortar member being located in the tapering sidewall of the cavity.

In a preferred embodiment of this apparatus, the diameter of the head-part of the anvil member decreases beginning with the zone thereof bearing the pressure face of the anvil member and in the direction toward the end of the head-part facing toward the interior of the cavity of the mortar member.

The mortar member can also have a flat frontal face and the anvil member has a flat frontal face opposite the flat frontal face of the mortar member, the flat frontal face of the anvil member containing the pressure face of the latter, and an annular rib protruding from the frontal face of the mortar member, the crest of the annular rib containing the pressure face of the mortar member.

In a particularly preferred embodiment, the apparatus for manufacturing a preformed closure element according to the invention as described above comprises an anvil member having a head part bearing a frontal face, and a mortar member, which parts are power-displaceable toward one another, the head part of the anvil member being of cylindrical or prismatic shape and bearing a first pressure plane which extends circumferentially thereabout, and has a rounded-off pressure edge zone at the upper pressure plane end, the sidewall of the anvil member above the pressure edge zone being beveled toward the frontal face of the anvil member and having a plurality of axial notches or grooves therein which cut across the rounded-off pressure edge zone, the mortar member having a recess in the face thereof directed toward the anvil member, which recess has a sidewall inwardly inclined away from the anvil member, whereby the cross-sectional area of the recess decreases in a direction away from the anvil member, the recess sidewall comprising a second pressure plane.

The aforesaid axial notches or grooves are preferably uniformly distributed about the entire circumference of the rounded-off pressure edge zone.

The process for sealing an opening of a can, of which steps (a) and (b) have been described hereinbefore, can be carried out, according to the invention, with the additional steps of:

(c) prior to or concurrently with or after one of steps (a) and (b) placing a circumferential zone of the collar part or of the flat part, which zone in the flat part is in the vicinity of the junction of the flat part and the collar part, between two pressure faces having a hardness greater than the membrane, and moving the two pressure faces toward or past one another in the general direction of an axis central and perpendicular to the flat part of the membrane, the two pressure faces approaching each other to leave a gap therebetween of a diameter smaller than the thickness of the deep-drawn membrane, thereby reducing the thickness of the membrane along a circumferential line destined to be ruptured, and (d) exerting pressure on the contact zone of the membrane along, or parallel with, the reduced diameter zone thereof destined to be ruptured, which pressure is applied from the space above the flat part of the membrane but inside the can opening and which pressure has a component directed outwardly (i.e. radially), from the central axis of the flat membrane part, in a pressure plane parallel to the flat part, and a component directed axially with regard to the flat membrane part, and concurrently there with heating the contact zone of the membrane, whereby the peripheral part and the collar part of the membrane are severed from one another in the said pressure plane, and each of these parts is glued or welded in the heated contact zone to the underlying portions of the lined can wall, while, at the same time, an annular zone of the can wall, uncovered by a membrane part and with an intact coating, is formed between the lowermost inside edge of the rim-covering peripheral membrane part and the upper edge of the collar part of the membrane.

The rupturing zone of reduced thickness can be produced prior to step (a) in a manner known per se by exerting a shearing pressure in the desired zone in the sealing range of the membrane, thus producing an annular zone which is thinner than the remainder of the deep-drawn membrane. Preferably, an additional annular groove is impressed into a region of the membrane which is destined to lie in the contact zone after deep drawing of the membrane.

The membrane can be scored in the rupturing zone, and this can be done in the above-mentioned groove or optionally below the latter. Preferably, a series of perforations are made in the membrane along the zone thereof destined to be ruptured, particularly if the membrane bears a relatively thick thermo-lacquer on its underside.

In a preferred mode of carrying out this process, the radial pressure component can be so strong that a continuous groove is impressed in the uncovered annular zone of the membrane without injuring the coating which lines the inside of the can wall.

At least one of the sidewalls of the last-mentioned continuous groove can be constituted by the bent-in lowermost inside edge portion of the rim-covering membrane part or by the bent-in upper edge region of the collar part of the membrane.

Preferably, the upper one of the two longitudinal sidewalls of the last-mentioned continuous groove is constituted by the bent-in lowermost inside edge region of the rim-covering membrane part and the lower one of these sidewalls is constituted by the bent-in upper edge region of the collar part of the membrane.

In another mode of carrying out this process of the invention in practice, the radial pressure is exerted in two planes parallel with one another and is so strong in each of these planes that an upper and a lower continuous groove are being impressed in the uncovered annular zone of the membrane without injuring the coating which lines the inside of the can wall, the upper sidewall of the upper continuous groove being constituted by the bent-in lowermost inside edge portion of the rim-covering membrane part, while the lower sidewall of the lower continuous groove is constituted by the bent-in upper edge portion of the collar part of the membrane, while the lower sidewall of the upper continuous groove and the upper sidewall of the lower continuous groove are constituted by corresponding impressions in the annular zone of the inside of the can wall, which zone is lined with intact coating.

An apparatus according to the invention for the manufacture of a sealed can by the process described in the foregoing, comprises a table having a top plane and an annular rim flange fastened to the table about the circumference of the latter and protruding upwardly above the top plane of the table, a stationary upright carrier element having a longitudinal axis disposed centrally relative to the top plane and carrying the table axially displaceably at the upper end of the carrier element, axial biassing means for biassing the table in upward direction on the carrier member, expandible pressure-exerting means disposed on the table top plane and being adapted for lateral outward displacement radially away from the longitudinal axis of the carrier element, and having at least one pressure face turned toward the inside wall of the annular rim flange, which inside wall constitutes a counterpressure face, and radial biassing means for urging the expandible pressure-exerting means away from the counterpressure face.

This carrier element preferably has a sidewall which is conically bevelled adjacent the upper end thereof and narrowing toward the latter.

The pressure-exerting means can comprise at least two segments each of which bears a pressure surface on its outer sides facing away from the carrier element.

Each segment of the pressure-exerting means preferably comprises adjusting means on the side thereof facing toward the carrier element, the adjusting means being adapted for adjusting the distance of the pressure surface of the respective segment from the longitudinal axis of the carrier element dependent upon the distance by which the table has been upwardly or downwardly displaced along the carrier element.

The adjusting means can have a sloped contact face which is in axially displaceable contact with the conically bevelled sidewall of the carrier element.

In order to attain the object of this invention of providing a process for producing a rupturing zone or line, in a sealing membrane, with satisfactory accuracy and independently of the configuration of the cross-section of a can opening which is to be sealed by the membrane, the membrane is given its permanent shape by subjecting it, only in the aforesaid rupturing zone or along the aforesaid rupturing line, to pressure between two pressure faces which are harder than the membrane, before the membrane is introduced into the can opening.

This has the advantage that the mortar member and the anvil member pertaining thereto can easily be made of any desired configuration corresponding to that of the can. It is a further advantage of this process according to this invention aspect that very thin foils of, for instance, only 0.06 mm thickness can undergo this shaping treatment rapidly and without the production of waste. A further advantage of this invention aspect resides in the fact that variations in thickness of the foil within the limits of conventional production tolerances will not influence the effective tearing of the membrane at the rupturing zone or line.

Finally, a further advantage of this process aspect of the invention resides in the fact that the rupturing zone or line can be produced in the flat part of the membrane, destined to cover the opening of the can, as well as in the collar part of the membrane which is destined to be in contact with and fastened to the inside wall, surrounding the can opening, of the can body.

BRIEF DESCRIPTION OF THE DRAWINGS

The invention is now described in more detail with reference to the drawings wherein:

FIG. 3 is a view, partially in axial section, of part of an apparatus for manufacturing a preformed closure element, according to the invention;

FIG. 4 is a perspective view, partially cut away, of the apparatus of FIG. 3;

FIG. 6 is a partially sectional view in perspective of part of a closure element produced by means of the apparatus shown in FIGS. 3 and 4;

FIGS. 12 and 13 show segments of the can wall and a collar part of a membrane in two different embodiments;

Figure 1:
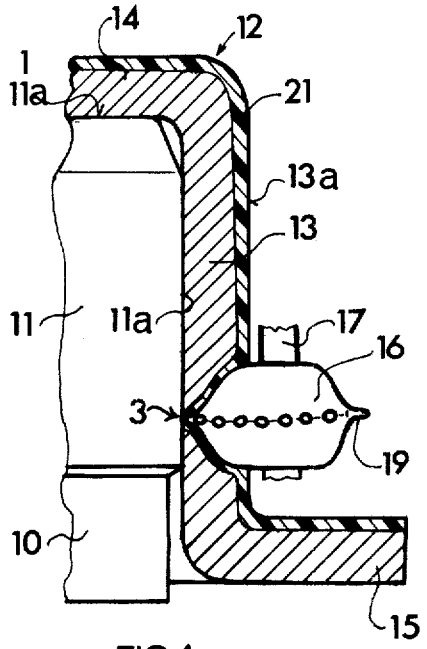
FIGS. 1 and 2 schematically illustrate the treatment of a deep-drawn membrane in a first step of the process for producing a rupturing zone or line, according to the invention.

Preferably, membranes made of aluminum foil are used to manufacture these embodiments.

DETAILED DESCRIPTION OF THE EMBODIMENTS SHOWN IN THE DRAWINGS

Figure 2:
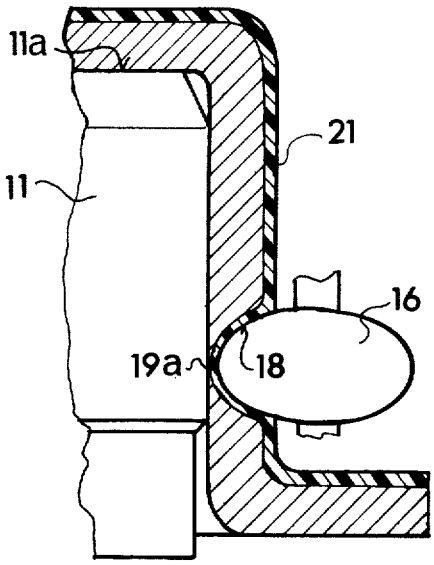

The apparatus for producing a preformed closure element according to the invention shown in FIGS. 1 and 2 comprises an anvil member or piston member 10 having an anvil head 11 and a pressure wall 11*a* and a frontal face 11*b*; a deep-drawn membrane 12, which is placed on the anvil head 11, is with its collar part 13 in contact with the pressure wall 11*a* of anvil head 11, while the flat foil part 14 of the membrane rests on the frontal face 11*b* of the anvil head 11. The rim-covering part 15 of membrane 12 is in the shape given it by deep drawing and extends radially away from anvil member 10. The outside 13*a* of membrane collar part 13 is then brought into contact with a roller 16 being part of the apparatus and mounted on a shaft 17. Shaft 17 is rotated by means of a drive and is urged against the outside surface of membrane collar part 13 by means of biassing members (not shown). Shaft 17 and roller 16 thereon are then circled about the plastics-coated metallic collar part 13 of the membrane in a plane which extends radially to the longitudinal axis of the cylindrical pressure wall 11*a*. This movement produces in the outside 13*a* a circumferential inward bighting or groove 18. Preferably, roller 16 is provided with projections, for instance, teeth 19 on its circumference, which will produce perforations (holes 19*a*) when sufficiently urged against the membrane collar part 13.

A coating 21 of plastics material, in particular, a layer of thermo-lacquer, which preferably covers the side of membrane 12 which faces away from anvil member 10, will not be damaged by the processing in the above-described apparatus, apart from a perforation if the latter is desired. As explained herein before, this perforation is of special advantage, when the membrane is coated with relatively thick layer of thermo-lacquer. That side of the flat part 14 of membrane 12 covering the interior of the can which bears this plastics layer faces the interior in the finished sealed can.

By this treatment, the deformation producing the zone to be ruptured occurs over a broader zone above and below the desired rupturing line, thus saving the material of the membrane and of the plastics layer borne thereby.

When manufacturing a sealed can according to the invention, a preformed closure element can be used as a membrane, which element is produced in an apparatus illustrated in FIGS. 3 and 4, which apparatus consists of an anvil member 30 and a mortar member 31, having an internal cavity 32, the sidewall 33 of which surrounds the upper end of anvil member 30. Mortar member 31 bears on the internal slightly inwardly sloped sidewall 33 of cavity 32 a conical pressure face 33*a*. The anvil head 34 has a circumferential cylindrical wall surface 35 and is provided with a rim surface 37 which is conically bevelled toward the frontal face 36 of anvil 30, forming a pressure edge 38 between rim surface 37 and the cylindrical wall surface 35. In this apparatus, a membrane 20 is so deformed that in the wall of the membrane collar part 23 there is produced an external indentation or groove 24 facing toward the can wall, and an internal indentation or groove 25, as shown in FIG. 5.

Figure 5:
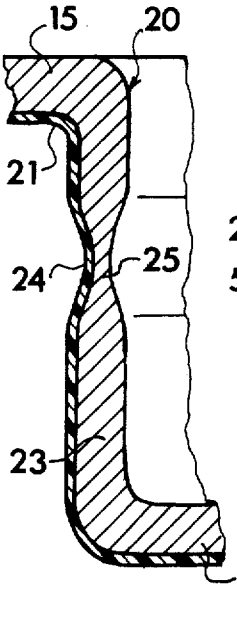
FIG. 5 is a sectional view of part of the preformed closure element obtained by processing according to FIGS. 1 and 2.

When the apparatus shown in FIGS. 3 and 4 is provided with small, axially extending transverse grooves 39 uniformly distributed about the circumference of the bevelled rim surface 37 of anvil head 34, which transverse grooves 39 have a maximum depth 39*a* in lieu of the pressure edge 38', and which end in the wall surface 35, then, in such an apparatus as shown in FIG. 4, there is produced by deformation of the membrane 12 a preformed closure element 22 (FIG. 6) which possesses a circumferential perforation 22*a*, while its cross-sectional area generally corresponds to that of the closure element shown in FIG. 5.

A closure element similar to that shown in FIG. 5 can also be produced when anvil member 10 shown in FIGS. 1 and 2 bears in lieu of the integral anvil head 11 a counter-roller (not shown) which has a similar configuration of its sidewall as roller 16, but bears no teeth and has preferably the same diameter in a plane radial to the central anvil axis as anvil head 11.

Figure 7:
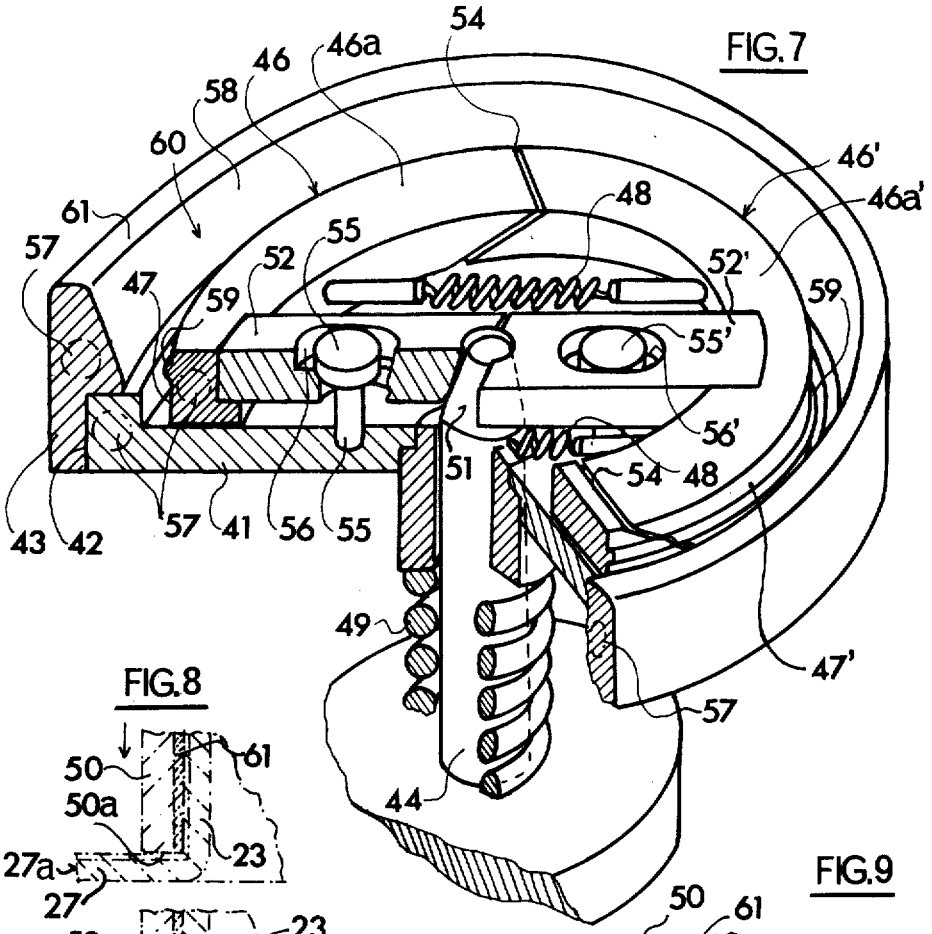
FIG. 7 is a perspective view, partially cut away, of a first embodiment of the apparatus according to the invention for producing a sealed can, the sealing of which is shown in FIGS. 10 and 11, respectively, infra.

In FIG. 7 there is shown an apparatus for the manufacturing of a sealed can according to the invention. Essential components of this apparatus are a table 41 having an annular flange 43 protruding upwardly from the top plane of the table about the circumference of the same, and which is fastened to the rim face 42 of the table in a manner known per se, for instance, by welding or screw-connection, as well as a stationary, upright carrier element 44 which is disposed centrally with regard to table 41. Table 41 is supported by the upper end of carrier element 44 and is downwardly displaceable, but biassed upwardly, along carrier element 44. The upward bias is imparted to table 41 by a spring 49 which is set to hold the table 41 at the upper end of carrier element 44. On the top face of table 41 there is mounted an expandible pressure-exerting means 45 which comprises at least two segments 46, 46' which are movable outwardly away from the carrier element 44 against a bias in inward direction and bear on their outer sides turned away from the carrier element 44 pressure faces 47, 47'.

The bias of the segments of the pressure-exerting means is generated by means of tension springs 48 which endeavor to pull toward each other segments 46, 46' which are located on opposite sides of the longitudinal axis of carrier element 44.

On the inside surface of rim flange 43 there is provided an annular counter-pressure plane 58 for cooperation with the pressure faces 47, 47' of segments 46, 46'.

In the embodiment of the pressure element 44 shown in FIG. 7, it has the shape of a column, the free, preferably upwardly-directed end of which is conically tapered, so that its mantle surface 51 is inclined and of a cross-section which decreases in upward direction.

Correspondingly, each of the segments 46, 46' has a transverse bar 52, 52' associated therewith, each transverse bar having at its end adjacent to the carrier element 44 a tapered contact face 53 which rests displaceably on the tapered side mantle 57 at the upper end of carrier element 44.

Preferably, in this case, the segments 46, 46' are separated from each other by a gap 54 extending obliquely to the circumference between the upper and the lower annular circumferential faces of the segments 46 and 46'. In order to guide the transverse bars 52, 52' in radial direction on the table 41, the latter is provided with guiding projections 55, 55' which protrude into corresponding slots 56, 56' of transverse bars 52, 52'. Electrical heating coils 57 are provided in table 41 as well as in annular flange 43 and may also be provided in the segments 46 and 46'.

A preferred closure element similar to that shown in FIG. 2 which, however, bears an annular groove 25 on that side of membrane collar part 23, which faces toward the space inside the can opening, is processed in order to seal a can according to the invention therewith, in the apparatus shown in FIG. 7, by process steps which will be explained in connection with FIGS. 8 and 9.

Figure 8:
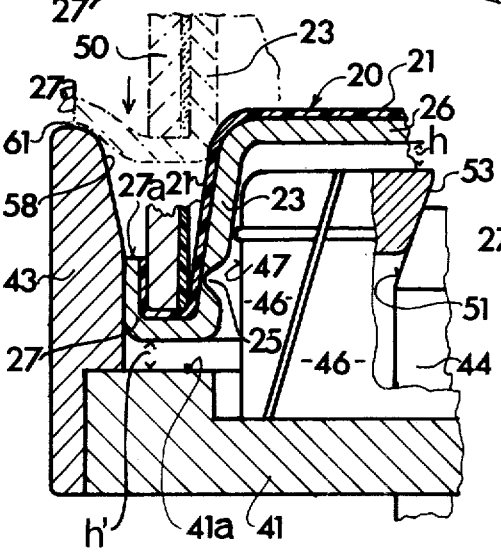
FIG. 8 is a cross-sectional view of the left-hand portion of a table of the apparatus shown in FIG. 7 together with a preformed membrane and the open end of a can during the introduction of the latter in three different stages, the first and second of these stages being shown in phantom lines.

As will be seen from FIG. 8, a membrane 20 is to be introduced with its deep-drawn cup part consisting of the flat part 26 destined to cover the can opening, its membrane collar part 23 and with its still undeformed can rim-covering part 27 into the opening of a can 50, and is with its rectangularly bent-away rim-covering part 27 above the rim **50*a* of the can opening (uppermost position in FIG. 8 shown in phantom lines). Can 50 and membrane 20 are now centered on the longitudinal axis of carrier element 44 and are moved downwardly to be introduced from above into the upwardly open annular gap 60 between the annular pressure face 58 of rim flange 43 and the pressure faces 47, 47' of segments 46, 46'. During this downward movement the outermost rim 27*a* of rim-covering part 27 is bent upwardly by coming into contact with the upper rounded rim 61 of annular flange 43 and is crimped about the rim 50*a*** of the can opening.

Thereupon, the flat part 26 of the membrane comes first into contact with the frontal top faces **46*a*, 46*a'* of segments 46, 46', before the can opening rim 50*a* together with the rim-covering part 27 of membrane 20 borne thereby abuts against the annular shoulder 41*a* of table 41, which shoulder is located at the bottom of the annular gap 60. To achieve this, distance h is slightly smaller than distance h' (FIG. 8). As the can 50 is further pressed downwardly into the annular gap 60, crimping of the rim-covering part 27 about the can opening rim 50*a* will stretch the region of the membrane 20 between the rim-covering part 27 and the membrane collar part 23 particularly at the groove 25, and this region will be torn apart, along the rupturing line, provided beforehand in collar part 23 of the membrane 20**.

While due to downward pressure exerted on the can, the can opening rim **50*a* and the region of the membrane covering the latter will abut against the annular shoulder 41*a* of table 41, this downward pressure in axial direction exerted on the can 50 will also move the table 41 downward on the carrier element 44 with simultaneous compression of spring 49. Thereby, contact faces 53 of transverse bars 52, 52' will slide downwardly on the tapered mantle 51 of the upper end of carrier element 44 and will be radially displaced outwardly away from the latter, whereby the segments 46, 46' which are engaged by their outward ends will be moved asunder and toward the annular counter-pressure face 58 with widening of the gap 54**.

The membrane collar part 23 and the rim-covering part 27 which latter has been pulled away from the former and separated therefrom due to the crimping of rim-covering part 27 about the can opening rim **50*a*, now leave free, i.e. uncovered by the membrane, an annular zone 62. In this zone the underlying region of the intact coating 61**, which lines the inside of the can, is now exposed.

The pressure faces 47, 47' now urge simultaneously the membrane collar part 23 and that portion of the rim-covering part 27 which lies on the inside wall of the can adjacent to the can opening rim **50*a* in the direction toward the counter-pressure face 58 and thereby firmly onto the inside can wall, and as the pressure faces 47, 47' of segments 46, 46' as well as the annular shoulder 41*a* and the counter-pressure face 58 can be heated by heating elements 57, the thermo-lacquer layer 21 which covers the outside of the membrane 20 will be softened and heat-welded or glued onto the can wall or onto the coating 61** of the latter.

As soon as the downwardly directed pressure on the can ceases, spring 49 will raise the table 41 to its upper starting position, the springs 48 will pull the segments 46 and 46' inwardly and away from the counter-pressure face 58 and the fully sealed can is released and can now be lifted automatically upwardly out of the apparatus.

Figure 10:
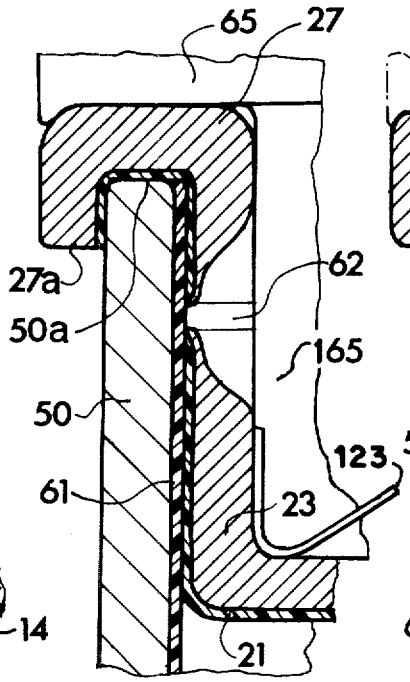
FIG. 10 is a view of part of a first embodiment of the upper end of a can bearing a membrane as obtained by the process according to the invention, the can being shown in longitudinal sectional view.
Figure 9:
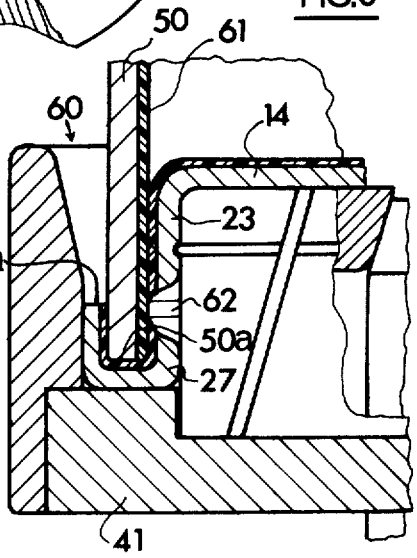
FIG. 9 is a cross-sectional view similar to that of FIG. 8, but with the membrane and the open can end completely glued together, and one of the segments of the apparatus shown in FIG. 7 being in pressing position.

In FIG. 10 is shown a partial view of a first embodiment of the upper end of a can sealed in accordance with the invention and lifted out of the apparatus of FIG. 7, in which embodiment like parts bear like reference numerals as in FIGS. 8 and 9. The can is further closed in a conventional manner by an outer lid 165 which covers the sealing membrane and is set into the cup-shaped recession in the top of the latter.

The wall of can 50 is then slipped from above over the collar part 13 which is still held in position by flat part 14 of the membrane which still rests on the frontal face **11*a* of anvil head 11, and the wall of can 50 will be moved further downwardly until it abuts against the horizontal region of the rim-covering part 15 of the membrane on the above-mentioned shoulder. Thereupon, the severed parts of the membrane, namely the collar part 13 and the rim-covering part 15, which latter is at the same time crimped about the can rim 50*a*, will be thermo-welded to the thermo-lacquer layer 21 of the membrane by heating of the anvil head 11 or a crimping tool which is brought into contact with the rim-crimping part 15** of the membrane from outside the slipped-over can.

An annular bead or rib 59 can be provided on the pressure faces 47, 47', preferably near the frontal faces **46*a*, 46*a'* of the segments 46, 46', which annular bead or rib 59 is only interrupted by the gap 54. This annular bead 59 facilitates the severance of the rim-covering part 27 from the membrane collar part 23** by being urged against the latter.

Figure 11:
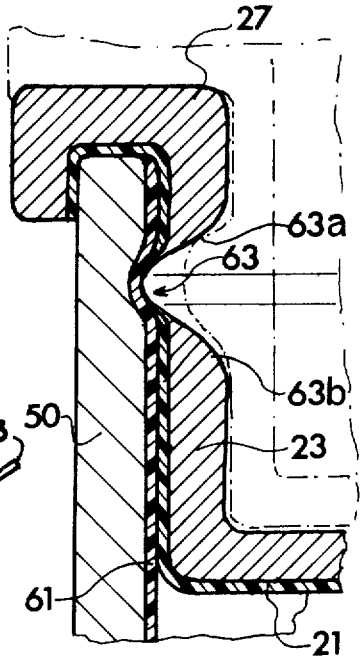
FIG. 11 shows a similar partial view of another embodiment of the upper can end.

When the pressure faces 47, 47' of the segments 46, 46' bear a thicker annular rib (not shown), for instance, underneath annular bead 59, then simultaneously during the process steps described in FIGS. 7, 8, and 9 a larger annular indentation 63 will be produced in the inside surface of the can wall in the region of the uncovered annular zone 62 between the membrane collar part 23 and the rim-covering part 27, which indentation 63 will, however, be so flat that it does not injure the coating 61 which lines the inside of the can wall. The upper longitudinal sidewall 63*a* of indentation 63 is thus formed by the inside lower edge zone of the rim-covering part 27 of membrane 20, while the lower longitudinal sidewall 63*b* of indentation 63 is formed by the upper edge zone of the membrane collar part 23 (FIG. 11).

By arranging correspondingly shaped annular ribs on the pressure faces 47, 47' of segments 46, 46' in the apparatus of FIG. 7 there can be produced in the membrane collar part 23 another annular indentation 64 which will run parallel to the indentation 63 described above (FIG. 12); or there can be produced two annular indentations 65 and 66 parallel with one another which can be impressed, for instance, at the upper and the lower edge of the annular zone 62 of coating not covered by the membrane. In this case, the upper sidewall of the upper indentation 65 will be formed by the inside edge region of the rim-covering part 27, while the lower sidewall of the lower indentation 66 will be formed by the upper edge region of collar part 23 of membrane 20 (FIG. 13).

These two embodiments of the sealing of a can also facilitate the complete, clean removal, from the can opening, of collar part 23 and the flat part 26, integral with and surrounded by the former, of the membrane 20.

A double roller can be used for impressing the two indentations 65 and 66 (FIG. 13). The common shaft of the double roller should extend parallel to the can axis and the double roller would be moved about the inside of the membrane collar part 23 after the latter has been inserted into the can opening. Alternatively, the shaft of the double roller could be stationary, and the can could be rotated so that the double roller would act on each point of the can wall in horizontal deforming planes, thereby generating the two indentations.

Preferably, the desired rupturing zone or line is not produced in the vicinity of the transition from the collar part 13 or 23, respectively, to the flat part 14, 26 covering the can opening, but the collar part 13, 23 down from the rupturing zone or line should have a certain height sufficient for a good sealing. The rupturing zone or line should therefore be applied more upwardly, so that the collar part 13, 23 is preferably higher than the region of the rim-covering part 15 which extends downwardly to the rupturing zone or line on the inside of the can wall. The same applies with regard to the perforation shown in FIG. 6.

In each case, a pull-tab 123 is preferably attached to the membrane either at the collar part or preferably at the flat part thereof, by means of which pull-tab the flat part and the collar part of the membrane can be pulled out of the can opening together completely and cleanly, i.e. without leaving any residual pieces attached to the can wall or torn off to drop into the can filling FIG. 10.

The apparatus shown in FIG. 7 can be used not only for cylindrical cans having a preferably circular cross-section, but, by a corresponding adaptation of the shape of the table, the angular flange thereabout, and the segments, it can also be used for sealing cans of prismatic configuration. Thus, a can of rectangular or, preferably, square cross-section having rounded prism edges can be sealed in an apparatus similar to that shown in FIG. 7, the pressure-exerting means comprising in this case four segments each of which has the shape of an isosceles or, preferably, an equilateral triangle, the tip of which is turned toward the longitudinal axis of the carrier column, while the base of each triangle forms one side of a rectangle or square. When the table, which in this case is also preferably rectangular, is moved downwardly on the carrier column, the triangular segments are moved away from the latter column in outward direction and separate the rim-covering part from the collar part of the membrane and seal the collar part to the inside of the can wall in the same manner as has been shown in FIGS. 8 and 9.

When the can has sharp prism edges instead of rounded ones, the sealing at each of the right angle corners formed between every two adjacent prism sides can be effected by a special sliding piece which is movable outwardly along the diagonal between every two adjacent triangular segments, filling the gap which is created between them when they are moved outwardly and apart from each other. The tip of the sliding piece entering into this gap is provided with two frontal faces enclosing a right angle between them and each being inclined at an angle of 45 degrees with the diagonal along which the respective sliding piece is advanced, when the can is of square cross-section. The sliding pieces can thus completely penetrate to the tip of an angle of 90 degrees formed on the inside between two lateral walls meeting at a longitudinal edge of the square prismatic can, thus ensuring a perfect seal even at this difficult point.

Figure 14:
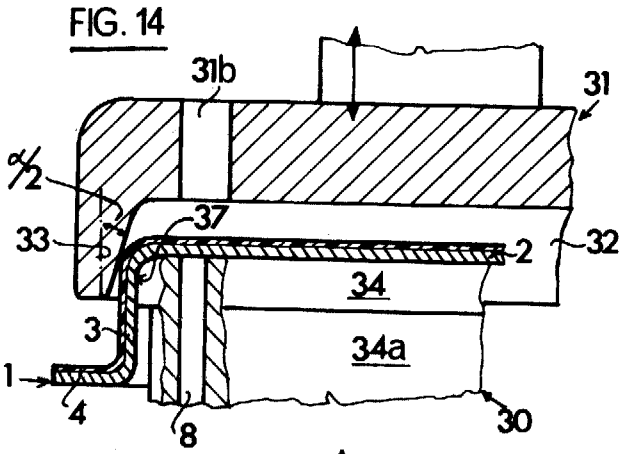
FIG. 14 shows schematically a first embodiment of a device for carrying out the process according to the invention for producing a rupturing zone or line.

In FIG. 14, reference numeral 1 designates a foil, preferably of aluminum or laminated aluminum, having a flat part 14, a collar part 13 extending toward the upper can rim and the rim-covering part 15 which is to be crimped about the upper-part rim. In order to carry out the respective process, the foil 1 which has preferably been deep-drawn, is placed on an anvil member 30 having an anvil head 34 and a carrier 34*a*. The diameter of carrier 34*a* is smaller than that of anvil head 34 so that foil 1 has only a relatively small zone of contact with anvil head 34, thereby, it is easier to slip onto anvil member 30 and to remove it therefrom. Air passages 8 provided in the anvil member 30 permit the escape of air trapped between foil 1 and the anvil head 34 when the former is slipped over the latter. At its front end 36, the anvil head 34 is provided with rounded edges ensuring that the foil 1 lies snugly on the frontal face 36. A mortar member 31 is arranged coaxially with the stationary member 30 and is axially displaceable relative to the latter in upper or downward direction. Hydraulic, pneumatic or mechanical means for moving the mortar member 31 are not shown. On its side facing the anvil member 30 the mortar member 31 has a frustoconical recess 32. The cone angle of the sidewall of recess 32 is so chosen that when the mortar member 31 is lowered, an annular pressure zone 33*a* in the sidewall 33 of recess 32 will come into contact with foil 1.

The annular zone 33*a* then comes to lie opposite an equally annular pressure zone 37 about the sidewall of head 34 of the anvil 30. Both the anvil member 30 and the mortar member 31 are made of a material which is considerably harder than the foil 1.

When the mortar member 31 is moved with great force abruptly or gradually toward the anvil member 30, then the foil 1 will be deformed between the annular planes 33*a* and 37, and the force executed by mortar member 31 must be sufficiently large so that the deformation of the foil 1 is a permanent one. In order to permit air entrapped between foil 1 and mortar member 31 to escape, air-escape channels 31*b* are provided in mortar member 31 to permit the escape of the air from above foil 1. In the permanently deformed region of the foil there is thus produced a rupturing line or zone along which the flat part 14 of the foil will tear when removing it from the opening of the can.

Figure 15:
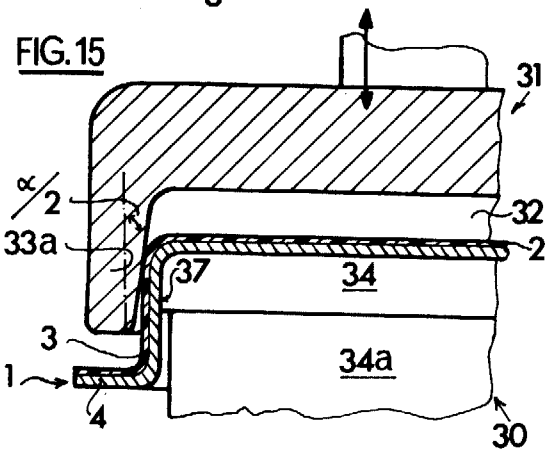
FIG. 15 shows a second embodiment of the apparatus for carrying out the last-mentioned process.
Figure 16:
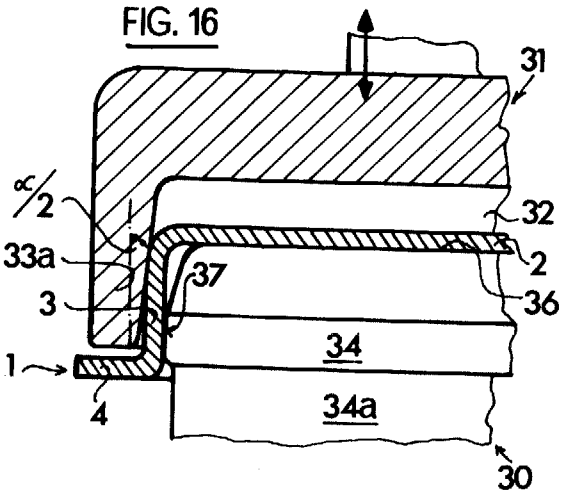
Figure 17:
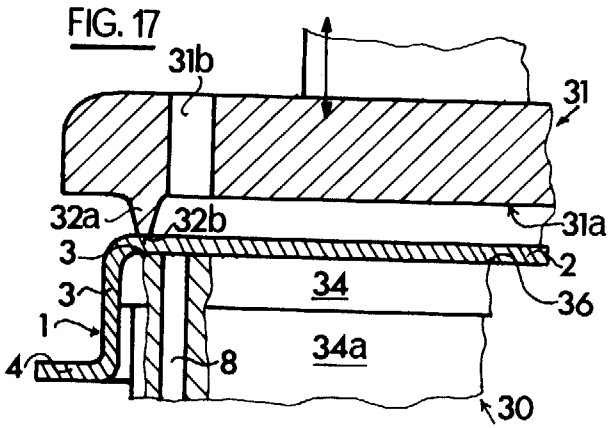
Figure 14:
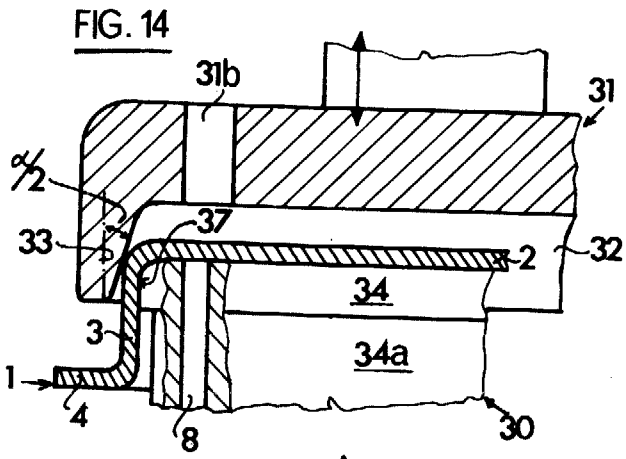
Figure 15:
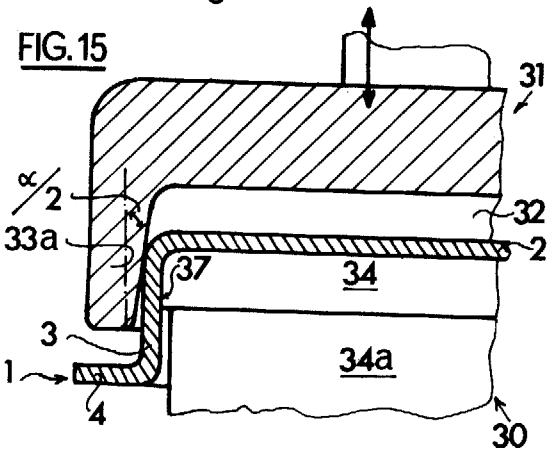

In the embodiment of an apparatus shown in FIG. 15, the anvil member 30 and the mortar member 31 are of similar configuration. The only difference is that the cone angle α of the sidewall of recess 32 is smaller in the embodiment of FIG. 15 than in that of FIG. 14. This smaller cone angle has the effect that the annular pressure zone 33*a* in which the recess 32 contacts the foil 1 when mortar member 31 is lowered, is in a region of the collar part 13 of the foil of greater distance from flat part 14 thereof. When the mortar member 31 is lowered abruptly or gradually with a correspondingly larger force, there will be a plastic reduction of the thickness of the foil 1 in the collar part 13, generated between the annular pressure zones 33*a* and 37, and consequently the formation of a rupturing zone or line 3 in this region of the collar part 13. This offers the advantage that the outside surface of the collar part 13 can be welded readily to the inside of the can wall, and damage occuring at the rupturing zone or line 3 during transportation will have no detrimental effect on the sealing of the can interior. Another advantage resides in that, when opening the can by tearing off the flat part 14 along the rupturing zone, no rough or sharp projections or edges will be produced at the foil part which remains in the can, thus avoiding any danger of injury.

Figure 16:
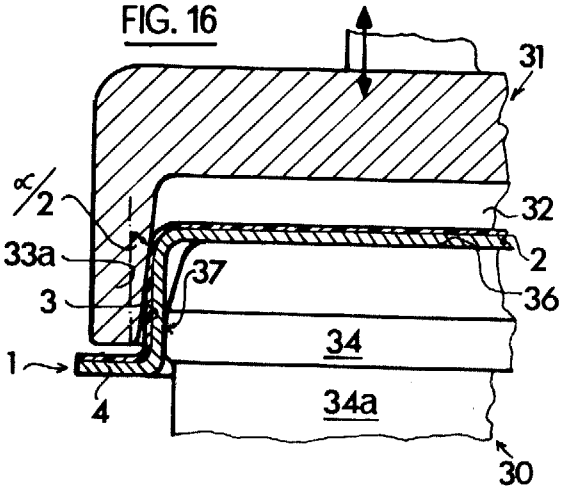
FIG. 16 shows a third embodiment of an apparatus for carrying out the last-mentioned process.

In the embodiment of an apparatus according to FIG. 16, the cone angle α is even smaller, i.e. the sidewall of the recess 32 is even steeper than in the embodiment of FIG. 15. Another difference in comparison with the previously described embodiments lies in the head 34 of the anvil member 30 being conically tapered at the end thereof facing the mortar member 31. Thereby, the annular pressure faces 33*a* and 37 contact the foil 1 approximately in the middle region of the collar part 13. When the mortar member 31 is moved downwardly under power abruptly or gradually to surround the head of anvil member 30, the plastic deformation of the foil 1 will occur in the collar part 13 to form the rupturing line 3 therein. In this embodiment, the foil 1 will be slightly conically deformed as indicated by phantom lines. This is no disadvantage as this deformation will be eliminated again when the membrane is introduced into the can opening. When tearing out the flat part 14 of the membrane, the portion of the collar part 13 which stays on the inside wall of the can shows no inwardly protruding edges or projections which could cause injuries to the user. In this embodiment the outside of the collar part 13 can also be welded to the inside of the can wall, whereby any damage to the rupturing zone 3 due to jolting during transport remains without detrimental effect on the contents of the can.

Figure 17:
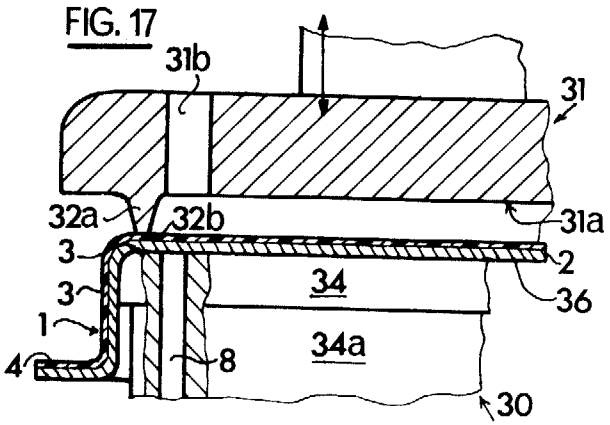
FIG. 17 shows a fourth embodiment for carrying out the last-mentioned process.

In the embodiment of FIG. 17, the underside 31*a* of the mortar member is flat and bears an annular rib 32*a*, the ridge of which constitutes an annular pressure surface 32*b* which contacts the flat part 34 of foil 1 near the periphery thereof where it is joined to the collar part 13. The annular pressure face 32*b* is opposed by a corresponding annular zone of the frontal face 36 of anvil member 30. Upon abrupt or gradual lowering of the mortar member 31 with pressure, the zone of the flat part 14 of foil 1, which lies between the annular pressure zones 32*a* and 36 is reduced in diameter, thus producing a rupturing zone in this part of the membrane.

In all four embodiments shown in FIGS. 14 to 17, air escape ducts 8 are provided which facilitate placing of the foil 1 on the anvil member 30 and permit lifting of the membrane after the application of the rupturing zone thereto by a short blast of compressed air. In all of these cases the manufacture of the tools 30 and 31 having corresponding round or polygonal contours depending on the shape of the membrane to be treated are relatively simple and inexpensive. Simple means for limiting the stroke of the mortar member 31 permits processing of foils of as little as 0.06 mm diameter or even less. This also permits production of a rupturing zone or line in foils which have variations in their thickness.

In other embodiments (not shown) the annular pressure faces 33 and 37 can be provided with small teeth, beads, knurlings or the like, whereby more or less strongly deformed sections of the rupturing zone or line can be produced in alternating sequence.

The processes and apparatus according to the invention have the advantage that the rupturing zone or line can be produced without difficulty at the deep-drawn membrane.

After application of the rupturing zone or line in the membrane 20, and prior to introducing the latter into a can, the foil 1 on membrane 20 is preferably coated with an elastic synthetic resin layer which seals the rupturing zone to protect it against possible damage during transportation. In all of the above-described embodiments of apparatus the anvil member 30 and/or the mortar member 31 can be supported by, or suspended from, an adjustible three-point support or suspension which facilitates adjusting the two tools to register correctly with one another.

I claim:

1. A deep-drawn preformed closure element adapted for the hermetic sealing of an opening of a can or similar container having a can body having a top and said opening in said top, the wall of which can body is lined on its inside surface with a protective coating which is rendered thermo-glueable upon heating, and said closure element being in a state ready for introduction and gluing into said opening of said can top and essentially consisting of a membrane deep drawn from an aluminum foil or similar sheet material, and being adapted for serving as a warranty seal for said container, said membrane comprising:

(a) a flat part, adapted for covering the top opening in said can body, (b) an annular collar part, joined to the periphery of said flat part, said membrane bearing at least on the side of said collar part destined to contact said can body, a coating which is rendered thermo-glueable upon heating, whereby said collar part is adapted for being glued to the thermo-glueable coating of the inside wall surrounding the top opening of said can body, (c) a peripheral rim-covering part, joined to the periphery of said collar part away from said flat part, and destined for covering the rim of said can about said can top opening, and (d) collar part rupturing line means comprising at least one endless reduced thickness portion in said collar part, extending all the way thereabout, in a zone of said collar part extending parallel to the peripheral junction of said flat part with said collar part and intermediate said last-mentioned junction and the peripheral junction of said collar part with said rim-covering part, for separating the closure element into two parts, during assembly of the closure element to the can, through tensioning of said collar part in a direction substantially perpendicular to said flat part, and inwardly toward the can interior, and heating the same, whereby an upper portion of said collar part, above said collar part-rupturing line means, becomes thermo-glued to the underlying protective coating of the can body wall in an upper contact zone of the latter, and a lower portion of said collar part, below said collar part-rupturing line means, becomes thermo-glued sealingly to the underlying protective coating in a second, lower zone of the can body wall, while leaving a circumferential zone of said protective coating intermediate said first and second contact zone thereof uncovered and intact.

2. The preformed closure element of claim 1, wherein said collar part has a plurality of perforations in said zone of reduced thickness.

3. The preformed closure element of claim 1 or 2, wherein said rim-covering part is bent away outwardly from said collar part at their common junction.

* * * * *